US011542453B2

(12) United States Patent
Nakanishi et al.

(10) Patent No.: US 11,542,453 B2
(45) Date of Patent: Jan. 3, 2023

(54) GREASE COMPOSITION, MECHANISM COMPONENT, AND PRODUCTION METHOD FOR GREASE COMPOSITION

(71) Applicant: IDEMITSU KOSAN CO.,LTD., Chiyoda-ku (JP)

(72) Inventors: Yusuke Nakanishi, Ichihara (JP); Hiromu Kumagai, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/980,870

(22) PCT Filed: Mar. 26, 2019

(86) PCT No.: PCT/JP2019/012967
§ 371 (c)(1),
(2) Date: Sep. 15, 2020

(87) PCT Pub. No.: WO2019/189239
PCT Pub. Date: Oct. 3, 2019

(65) Prior Publication Data

US 2021/0009916 A1 Jan. 14, 2021

(30) Foreign Application Priority Data

Mar. 30, 2018 (JP) ..... JP2018-069461

(51) Int. Cl.

| | |
|---|---|
| ***C10M 119/20*** | (2006.01) |
| ***C10M 101/00*** | (2006.01) |
| ***C10M 113/10*** | (2006.01) |
| ***C10M 113/16*** | (2006.01) |
| ***C10M 169/02*** | (2006.01) |
| *C10N 20/00* | (2006.01) |
| *C10N 30/00* | (2006.01) |
| *C10N 60/00* | (2006.01) |
| *C10N 20/06* | (2006.01) |
| *C10N 30/04* | (2006.01) |
| *C10N 50/10* | (2006.01) |
| *C10N 70/00* | (2006.01) |

(52) U.S. Cl.
CPC ..... *C10M 119/20* (2013.01); *C10M 101/00* (2013.01); *C10M 113/10* (2013.01); *C10M 113/16* (2013.01); *C10M 169/02* (2013.01); *C10M 2201/1036* (2013.01); *C10M 2205/0206* (2013.01); *C10M 2209/126* (2013.01); *C10M 2215/026* (2013.01); *C10N 2020/06* (2013.01); *C10N 2020/061* (2020.05); *C10N 2020/063* (2020.05); *C10N 2020/081* (2020.05); *C10N 2030/04* (2013.01); *C10N 2030/26* (2020.05); *C10N 2050/10* (2013.01); *C10N 2060/09* (2020.05); *C10N 2070/00* (2013.01)

(58) Field of Classification Search
CPC ..... C10M 119/20; C10M 101/00; C10M 113/10; C10M 113/16; C10M 169/02; C10M 2205/0206; C10M 2209/126; C10M 2201/1036; C10M 2215/026; C10N 2020/06
See application file for complete search history.

(56) References Cited

U.S. PATENT DOCUMENTS

| | | | | |
|---|---|---|---|---|
| 4,439,328 | A | 3/1984 | Moity | |
| 5,817,711 | A | 10/1998 | Kambe et al. | |
| 2004/0186025 | A1* | 9/2004 | Nakatani | C10M 119/22 508/130 |
| 2013/0012416 | A1* | 1/2013 | Fujinami | C10M 169/02 508/154 |
| 2018/0079983 | A1* | 3/2018 | Nakanishi | C10M 119/20 |

FOREIGN PATENT DOCUMENTS

| | | | |
|---|---|---|---|
| CN | 102604725 | A | 7/2012 |
| CN | 103468353 | A | 12/2013 |
| CN | 104629888 | A | 5/2015 |
| CN | 106479627 | A | 3/2017 |
| CN | 106544146 | A | 3/2017 |
| CN | 106675708 | A | 5/2017 |
| CN | 107532104 | A | 1/2018 |
| EP | 3 290 497 | A1 | 3/2018 |
| JP | 10-53789 | A | 2/1998 |
| JP | 2004-269789 | A | 9/2004 |
| JP | 2017-180526 | A | 10/2017 |
| JP | 2017-210612 | A | 11/2017 |
| WO | WO2011/118814 | A1 | 9/2011 |
| WO | WO2016/175258 | A1 | 11/2016 |

OTHER PUBLICATIONS

International Search Report dated Jun. 4, 2019 in PCT/JP2019/012967 filed Mar. 26, 2019, 2 pages.
Abe, K., "Preparation of Cellulose Nanofibers", Research Institute for Sustainable Humanosphere, No. 13, 2017, pp. 43-50.
Extended European Search Report dated Nov. 3, 2021 in European Patent Application No. 19774510.2, 9 pages.
Sagnite Ventura-Cruz, et al., "Nanocellulose and microcrystalline cellulose from agricultural waste: Review on isolation and application as reinforcement in polymeric matrices," Food Hydrocolloids, vol. 118, XP086555919, 2021, 10 pages.
Office Action dated Mar. 4, 2022, in Chinese Patent Application No. 201980022619.3.
Office Action dated Oct. 18, 2022, in Japanese Patent Application No. 2020-510950.

* cited by examiner

*Primary Examiner* — Vishal V Vasisth
(74) *Attorney, Agent, or Firm* — Oblon, McClelland, Maier & Neustadt, L.L.P.

(57) ABSTRACT

The present invention addresses a problem of providing a grease composition that uses hydrophilic nanofibers but still has excellent water resistance and does not readily experience oil separation. The grease composition contains a base oil, hydrophilic nanofibers having a thickness (d) of 1 to 500 nm, and an organic bentonite.

5 Claims, No Drawings

GREASE COMPOSITION, MECHANISM COMPONENT, AND PRODUCTION METHOD FOR GREASE COMPOSITION

This application is a 371 of PCT/JP2019/012967 filed Mar. 26, 2019.

TECHNICAL FIELD

The present invention relates to a grease composition, a mechanical component filled with the grease composition, and a method for producing the grease composition.

BACKGROUND ART

A grease composition is chiefly constituted of a base oil and a thickener. As the thickener, for example, a fatty acid metal salt such as lithium soap, and a diurea compound are widely used.

Recently, a greases composition using a biodegradable thickener has been proposed for providing a grease composition having a low environmental load. For example, PTL 1 proposes a grease composition using cellulose nanofibers (hereinafter also referred to as "CNF") as a thickener.

CITATION LIST

Patent Literature

PTL 1: JP 2017-210612 A

SUMMARY OF INVENTION

Technical Problem

The grease composition using hydrophilic nanofibers such as CNF as a thickener is insufficient in water resistance. In addition, it often experiences oil separation. One solution to the problem is to hydrophobize the hydrophilic nanofibers by substituting the hydrophilic group thereof with a hydrophobic functional group.

However, hydrophobizing hydrophilic nanofibers may impair stability and safety that the hydrophilic nanofibers originally have. Given the situation, it is desired to provide a grease composition having excellent water resistance and hardly experiencing oil separation though using such hydrophilic nanofibers.

The present invention has been made in consideration of such demands, and its object is to provide a grease composition that uses hydrophilic nanofibers but still has excellent water resistance and does not readily experience oil separation, and to provide a mechanical component filled with the grease composition and a method for producing the grease composition.

Solution to Problem

The present inventors have found that a grease composition containing hydrophilic nanofibers and an organic bentonite can solve the above-mentioned problems, and have completed the present invention.

Specifically, the present invention is concerned with the following [1] to [9].

[1] A grease composition containing a base oil, hydrophilic nanofibers having a thickness (d) of 1 to 500 nm, and an organic bentonite.

[2] The grease composition according to the above [1], wherein the content ratio of the hydrophilic nanofibers to the organic bentonite is 0.2 to 5.0 as a ratio by mass.

[3] The grease composition according to the above [1] or [2], wherein the content of the hydrophilic nanofibers is 0.1 to 20% by mass based on the total amount of the grease composition.

[4] The grease composition according to any of the above [1] to [3], wherein the content of the organic bentonite is 0.01 to 15% by mass based on the total amount of the grease composition.

[5] The grease composition according to any of the above [1] to [4], wherein the aspect ratio of the hydrophilic nanofibers is 5 or more.

[6] The grease composition according to any of the above [1] to [5], wherein the hydrophilic nanofibers contain one or more polysaccharides selected from cellulose, carboxymethyl cellulose, chitin and chitosan.

[7] A mechanical component filled with the grease of any of the above [1] to [6].

[8] A method for producing a grease composition, including the following steps (1) to (3):

Step (1); a step of mixing a water dispersion prepared by blending hydrophilic nanofibers having a thickness (d') of 1 to 500 nm in water, a base oil and a dispersant to prepare a liquid mixture;

Step (2); a step of removing water from the liquid mixture to prepare a grease;

Step (3); a step of blending an organic bentonite in the grease. [9] The method for producing a grease composition according to the above [8], wherein the dispersant is one or more selected from aprotic polar solvents, alcohols and surfactants.

Advantageous Effects of Invention

According to the present invention, there can be provided a grease composition that uses hydrophilic nanofibers but still has excellent water resistance and does not readily experience oil separation, a mechanical component filled with the grease composition, and a method for producing the grease composition.

DESCRIPTION OF EMBODIMENTS

[Embodiment of Grease Composition of the Present Invention]

The grease composition of the present invention is a grease composition (first grease composition) containing a base oil, hydrophilic nanofibers having a thickness (d) of 1 to 500 nm, and an organic bentonite.

The grease composition of another embodiment of the present invention is a grease composition (second grease composition) obtained according to the production method for a grease composition of the present invention. The production method for a grease composition of the present invention includes the following steps (1) to (3).

Step (1); a step of mixing a water dispersion prepared by blending hydrophilic nanofibers having a thickness (d') of 1 to 500 nm in water, a base oil and a dispersant to prepare a liquid mixture.

Step (2): a step of removing water from the liquid mixture to prepare a grease.

Step (3): a step of blending an organic bentonite in the grease.

The second grease composition is a grease composition obtained by preparing the liquid mixture and then removing at least water from the liquid mixture, but may also be a grease composition obtained by removing water and the dispersant from the liquid mixture.

Details of the water dispersion and the dispersant are described hereinunder in the section of "Production Method for Grease Composition of the present Invention".

In this description, "the first grease composition" and "the second grease composition" may be collectively referred to as "the grease composition of the present invention" or "the grease composition of one embodiment of the present invention".

In the first grease composition, the thickness (d) of the hydrophilic nanofibers that the grease composition contains is defined. In other words, the thickness (d) of the hydrophilic nanofibers dispersed in the base oil is defined. On the other hand, in the second grease composition, the thickness (d') of the hydrophilic nanofibers before mixed with the base oil is defined.

Satisfying the definition, the hydrophilic nanofibers can readily form a high-order structure in the base oil. In addition, the hydrophilic nanofibers can be readily uniformly dispersed in the base oil.

Further, the first grease composition and the second grease composition contain an organic bentonite. The hydrophilic surface (the surface having a hydrophilic group) of the organic bentonite adsorbs the hydrophilic group of the hydrophilic nanofibers or the hydrophilic surface thereof comes close to the hydrophilic group of the hydrophilic nanofibers, and therefore the organic bentonite disperses close to the uniformly dispersing hydrophilic nanofibers. As a result, the organic bentonite is uniformly dispersed and arranged to likely surround the hydrophilic group of the hydrophilic nanofibers. Consequently, it is presumed that the hydrophilic nanofibers could be simulatively hydrophobized and excellent water resistance could be thereby given to the grease composition and oil separation from the grease composition can be prevented.

Moreover, as described above, the hydrophilic nanofibers can readily form a high-order structure and the hydrophilic nanofibers and the organic bentonite can be readily uniformly dispersed in the base oil, and therefore, even though the content of the hydrophilic nanofibers is small and the content of the organic bentonite is also small, a grease composition having a suitable worked penetration can be thereby provided.

In addition, the hydrophilic nanofibers and the organic bentonite have a low environmental load and are excellent in safety for human bodies. Accordingly, the grease composition of the present invention has a low environmental load and has a high safety for human bodies.

Here, "the content of the hydrophilic nanofibers is small" means that the content of the hydrophilic nanofibers is 20% by mass or less based on the total amount (100% by mass) of the grease composition, preferably 15% by mass or less, more preferably 10% by mass or less.

Also, "the content of the organic bentonite is small" means that the content of the organic bentonite is 15% by mass or less based on the total amount (100% $b_y$ mass) of the grease composition, preferably 10% by mass or less, more preferably 8% by mass or less.

The grease composition of one embodiment of the present invention may further contain any other component along with the base oil, the hydrophilic nanofibers and the organic bentonite, within a range not detracting from the advantageous effects of the present invention. For example, it can contain various additives that are blended in ordinary grease compositions.

In the grease composition of one embodiment of the present invention, preferably, the total content of the base oil, the hydrophilic nanofibers and the organic bentonite is 50% by mass or more based on the total amount (100% by mass) of the grease composition, more preferably 60% by mass or more, even more preferably 70% by mass or more, further more preferably 80% by mass or more, further more preferably 90% by mass or more.

In the grease composition of one embodiment of the present invention, from the viewpoint of imparting better water resistance and from the viewpoint of more preventing oil separation, the content ratio (B/A) of the hydrophilic nanofibers (B) to the organic bentonite (A) is preferably, as a ratio by mass, 0.2 to 5.0, more preferably 0.2 to less than 5.0, even more preferably 0.5 to 4.5, further more preferably 0.8 to 4.3, further more preferably 1.0 to 4.2.

The components that are included in the grease composition of the present invention are hereunder described.

In the first grease composition and the second grease composition of the present invention, details of the base oil, details of the hydrophilic nanofibers, and details of the organic bentonite are the same.

<Base Oil>

The base oil that is contained in the grease composition of the present invention is properly selected according to an application, and examples thereof include mineral oils, synthetic oils, animal oils, vegetable oils, and liquid paraffins.

The base oil may be either a base oil composed of a single kind or a mixed base oil of two or more kinds thereof.

(Mineral Oil)

Examples of the mineral oil include distillates obtained through atmospheric distillation of paraffinic base oils, intermediate base oils or naphthenic base oils, or through reduced pressure distillation of atmospheric distillation residues; refined oils obtained by subjecting such distillates to at least one or more refining treatments selected from refining treatments such as solvent deasphalting, solvent extraction, hydrocracking or hydrogenation refining, as well as refining treatments such as solvent dewaxing or catalytic dewaxing (specifically, a solvent-refined oil, a hydrogenated refined oil, a dewaxing treated oil, a white clay treated oil); mineral oils obtained through isomerization of wax produced by the Fischer-Tropsch process (GTL wax (gas to liquids wax)).

Among those mineral oils, mineral oils classified into Group 3 of the base oil category according to API (American Petroleum Institute) are preferred.

(Synthetic Oil)

Examples of the synthetic oil include hydrocarbon-based oils, aromatic oils, ester-based oils, ether-based oils, and fatty acid esters.

Examples of the hydrocarbon-based oil include a normal paraffin, an isoparaffin, a poly-α-olefin (PAO), such as polybutene, polyisobutylene, a 1-decene oligomer, a co-oligomer of 1-decene and ethylene, and hydrides thereof.

Examples of the aromatic oil include alkylbenzenes, such as a monoalkylbenzene, a dialkylbenzene; and alkylnaphthalenes, such as a monoalkylnaphthalene, a dialkylnaphthalene, a polyalkylnaphthalenes.

Examples of the ester-based oil include diester-based oils, such as dibutyl sebacate, di-2-ethylhexyl sebacate, dioctyl adipate, diisodecyl adipate, ditridecyl adipate, ditridecyl glutarate, methyl acetyl ricinoleate; aromatic ester-based oils, such as trioctyl trimellitate, tridecyl trimellitate, tetraoctyl pyromellitate; polyol ester-based oils, such as trimethylolpropane caprylate, trimethylolpropane pelargonate, pentaerythritol-2-ethyl hexanoate, pentaerythritol pelargonate; and complex ester-based oils, such as an oligo ester between a polyhydric alcohol and a mixed fatty acid of a dibasic acid and a monobasic acid.

Examples of the ether-based oil include polyglycols, such as polyethylene glycol, polypropylene glycol, polyethylene glycol monoether, polypropylene glycol monoether; and phenyl ether-based oils, such as a monoalkyl triphenyl ether, an alkyl diphenyl ether, a dialkyl diphenyl ether, pentaphenyl ether, tetraphenyl ether, a monoalkyl tetraphenyl ether, a dialkyl tetraphenyl ether.

The fatty acid that constitutes the fatty acid ester is preferably a fatty acid having 8 to 22 carbon atoms, and specifically, examples thereof include caprylic acid, capric acid, lauric acid, myristic acid, palmitic acid, stearic acid, behenic acid, erucic acid, palmitoleic acid, oleic acid, linoleic acid, linolenic acid, isostearic acid, arachidic acid, ricinoleic acid, and 12-hydroxystearic acid.

Specifically, examples of the fatty acid ester include a glycerin fatty acid ester, a polyglycerin fatty acid ester, and a propylene glycol fatty acid ester.

Examples of the glycerin fatty acid ester include glycerin monooleate, glycerin monostearate, glycerin monocaprylate, glycerin dioleate, glycerin distearate, and glycerin dicaprylate.

Examples of the polyglycerin fatty acid ester include diglycerin monooleate, diglycerin monoisostearate, diglycerin dioleate, diglycerin trioleate, diglycerin monostearate, diglycerin distearate, diglycerin tristearate, diglycerin triisostearate, diglycerin monocaprylate, diglycerin dicaprylate, diglycerin tricaprylate, triglycerin monooleate, triglycerin dioleate, triglycerin trioleate, triglycerin tetraoleate, triglycerin monostearate, triglycerin distearate, triglycerin tristearate, triglycerin tetrastearate, triglycerin monocaprylate, triglycerin dicaprylate, triglycerin tricaprylate, triglycerin tetracaprylate, diglycerin monooleic acid monostearic acid ester, diglycerin monooleic acid distearic acid ester, diglycerin monocaprylic acid monostearic acid ester, triglycerin monooleic acid monostearic acid ester, triglycerin dioleic acid distearic acid ester, triglycerin dioleic acid monostearic acid ester, triglycerin monooleic acid monostearic monocaprylic acid ester, diglycerin monolaurate, diglycerin dilaurate, triglycerin monolaurate, triglycerin trilaurate, triglycerin trilaurylate, diglycerin monomyristate, diglycerin dimyristate, triglycerin monomyristate, triglycerin dimyristate, triglycerin trimyristate, diglycerin monolinoleate, diglycerin triglycerin monolinoleate, triglycerin dilinoleate, triglycerin trilinoleate, decaglycerin monooleate, decaglycerin monostearate, and decaglycerin monocaprylic acid monooleic acid ester.

Examples of the propylene glycol fatty acid ester include propylene glycol monooleate, propylene glycol monostearate, propylene glycol monocaprylate, and propylene glycol monolaurate.

(Vegetable Oil)

The vegetable oil is a plant-derived oil, and specifically, examples thereof include rapeseed oil, peanut oil, corn oil, cottonseed oil, canola oil, soybean oil, sunflower oil, palm oil, coconut oil, safflower oil, camellia oil, olive oil, and groundnut oil.

(Animal Oil)

The animal oil is an animal-derived oil, and specifically, examples thereof include lard, neat's foot oil, chrysalis oil, sardine oil, and herring oil.

(Liquid Paraffin)

Examples of the liquid paraffin include alicyclic hydrocarbon compounds having a branched structure or a ring structure and represented by $C_mH_n$ (m is number of carbon atoms, provided that n<(2m+2)), and mixtures thereof.

Among the above-mentioned base oils, from the viewpoint of an affinity of the base oil with the hydrophilic nanofibers and the organic bentonite, the base oil to be contained in the grease composition of one embodiment of the present invention preferably contains one or more selected from mineral oils classified into Group 3 of the base oil category according to API, synthetic oils, vegetable oils, animal oils, fatty acid esters, and liquid paraffins.

(Kinematic Viscosity and Viscosity Index of Base Oil)

A kinematic viscosity at 40° C. of the base oil that is used in one embodiment of the present invention is preferably 10 to 400 $mm^2/s$, more preferably 15 to 300 $mm^2/s$, still more preferably 20 to 200 $mm^2/s$, and yet still more preferably 20 to 130 $mm^2/s$.

When the kinematic viscosity is 10 $mm^2/s$ or more, a phenomenon in which the grease causes oil separation may be inhibited.

On the other hand, when the kinematic viscosity is 400 $mm^2/s$ or less, the oil is readily supplied into sliding portions.

As for the base oil that is used in one embodiment of the present invention, a mixed base oil prepared by combining a high-viscosity base oil and a low-viscosity base oil to control the kinematic viscosity thereof to the aforementioned range can also be used.

A viscosity index of the base oil that is used in one embodiment of the present invention is preferably 60 or more, more preferably 70 or more, and still more preferably 80 or more.

In the present invention, the kinematic viscosity at 40° C. and the viscosity index mean values as measured or calculated in conformity with JIS K2283:2000.

(Content of Base Oil)

The content of the base oil that is included in the grease composition of one embodiment of the present invention is preferably 50% by mass or more, more preferably 60% by mass or more, still more preferably 70% by mass or more, and yet still more preferably 80% by mass or more, based on the total amount (100% by mass) of the grease composition.

<Hydrophilic Nanofibers>

In the present invention, the hydrophilic nanofibers mean a fibrous material constituted of a forming material including a compound with hydrophilicity and having a thickness of 500 nm or less and is distinguished from a flaky material, a powdery material, and a granular material.

(Evaluation Criteria for "Hydrophilicity")

Whether or not nanofibers are "hydrophilic" is determined as follows. Targeted nanofibers (of a fibrous material) are formed into a sheet, and water drops are dropped onto the sheet. At that time, when (1) a contact angle against water is 90° or less, or when (2) the water droplet dropped is quickly absorbed on the sheet, the nanofibers are determined to be "hydrophilic".

("Thickness" of Hydrophilic Nanofibers)

The definition of the "thickness" of the hydrophilic nanofibers is the same as the definition of the thickness of ordinary fibrous materials.

Specifically, in a cut surface at the time of cutting perpendicularly to the tangent direction in an arbitrary point on the side surface of the hydrophilic nanofiber, when the cut surface is a circle or an oval, then the "thickness" of the hydrophilic nanofiber refers to a diameter or a major axis, whereas when the cut surface is a polygon, then the "thickness" of the hydrophilic nanofiber refers to a diameter of a circumcircle of the polygon.

In the case where a flaky, powdery, or granular hydrophilic compound having a size of several μm or more is blended as a thickener in the base oil, the hydrophilic compound is aggregated in the base oil and is liable to form a so-called "lump". As a result, an aggregate of the hydrophilic compound is deposited on the surface of the obtained grease composition, and the dispersed state is liable to become non-uniform. In this case, in order to increase the worked penetration of the resultant grease composition, the addition of a large quantity of the hydrophilic compound is needed. However, as containing particles larger than the oil film thickness, the resultant grease composition becomes inferior in wear resistance.

On the other hand, in the grease composition of the present invention, since the hydrophilic nanofibers having a thickness (d) of 1 to 500 nm is blended in the base oil, the hydrophilic nanofibers are not aggregated in the base oil and, while uniformly dispersed therein, the hydrophilic nanofibers can form a higher-order structure. As a result, nevertheless the content of the hydrophilic nanofibers therein is low, a grease composition having an appropriate worked penetration may be provided here.

(Thickness (d) and Aspect Ratio of Hydrophilic Nanofibers)

In the present invention, the "thickness (d) of the hydrophilic nanofibers" refers to a thickness of the hydrophilic nanofibers dispersed in the base oil and is distinguished from the "thickness (d') of the hydrophilic nanofibers" as a raw material prior to being blended in the base oil as described later.

However, there is little difference between the "thickness (d) of the hydrophilic nanofibers" dispersed in the base oil, and the "thickness (d') of the hydrophilic nanofibers" as a raw material prior to being blended in the base oil. Accordingly, the "thickness (d) of the hydrophilic nanofibers" dispersed in the base oil, and the "thickness (d') of the hydrophilic nanofibers" as a raw material prior to being blended in the base oil can be considered to be substantially the same.

The thickness (d) of the hydrophilic nanofibers dispersed in the base oil is 1 to 500 nm; however, in the base oil, from the viewpoint that the hydrophilic nanofibers form a high-order structure and from the viewpoint that the hydrophilic nanofibers are more uniformly dispersed, the thickness (d) is preferably 3 to 300 nm, more preferably 5 to 200 nm, still more preferably 10 to 100 nm, even more preferably 15 to 70 nm, further more preferably 20 to 50 nm.

In the grease composition of the present invention, the dispersion of the hydrophilic nanofibers of which at least the thickness (d) falls within the aforementioned range only have to be confirmed, and hydrophilic nanofibers whose thickness (d) falls outside the aforementioned range may also be dispersed.

However, in the grease composition of one embodiment of the present invention, from the viewpoint that the hydrophilic nanofibers form a high-order structure in the base oil and from the viewpoint that the hydrophilic nanofibers are more uniformly dispersed therein, an average value of the thickness (d) of ten hydrophilic nanofibers that are arbitrarily selected from the hydrophilic nanofibers dispersed in the base oil is preferably 1 to 500 nm, more preferably 3 to 300 nm, even more preferably 5 to 200 nm, further more preferably 10 to 100 nm, further more preferably 15 to 70 nm, further more preferably 20 to 50 nm.

Also from the aforementioned viewpoint, among the hydrophilic nanofibers included in the grease composition of the present invention, in ten arbitrarily selected hydrophilic nanofibers, the number of the hydrophilic nanofibers whose thickness (d) falls within the aforementioned range is preferably 1 or more (more preferably 5 or more, and still more preferably 7 or more). It is more preferred that all of the ten selected hydrophilic nanofibers are the hydrophilic nanofibers having a thickness (d) falling within the aforementioned range.

In the grease composition of one embodiment of the present invention, an aspect ratio of the hydrophilic nanofibers is preferably 5 or more, more preferably 10 or more, still more preferably 15 or more, even more preferably 30 or more, further more preferably 50 or more.

In this description, the "aspect ratio" is a ratio of a length of the hydrophilic nanofiber objective to the observation to the thickness thereof [length/thickness], and the "length" of the hydrophilic nanofiber refers to a distance between the farthest two points of the hydrophilic nanofiber.

In the case where a part of the hydrophilic nanofiber objective to the observation comes into contact with another hydrophilic nanofiber, so that it is difficult to recognize the "length", among the hydrophilic nanofibers objective to the observation, the length of only a portion where it is possible to measure the thickness thereof is measured, and as a result, the aspect ratio of the foregoing portion may fall within the aforementioned range.

Furthermore, an average value of the aspect ratio (hereinafter also referred to as "average aspect ratio") of ten arbitrarily selected hydrophilic nanofibers among the hydrophilic nanofibers included in the grease composition of the present invention is preferably 5 or more, more preferably 10 or more, still more preferably 15 or more, even more preferably 30 or more, further more preferably 50 or more.

(Thickness (d') and Aspect Ratio of Hydrophilic Nanofibers)

The thickness (d') of the hydrophilic nanofibers as a raw material prior to being blended in the base oil is preferably 1 to 500 nm, more preferably 3 to 300 nm, still more preferably 5 to 200 nm, still more preferably 10 to 100 nm, still more preferably 5 to 70 nm, still more preferably 20 to 50 nm.

The average aspect ratio of the hydrophilic nanofibers as a raw material prior to being blended in the base oil is preferably 5 or more, more preferably 10 or more, still more preferably 15 or more, still more preferably 30 or more, still more preferably 50 or more.

In this description, the "thickness (d)" of the hydrophilic nanofibers dispersed in the base oil and the "thickness (d')" of the hydrophilic nanofibers as a raw material prior to being blended in the base oil as well as the aspect ratio of such hydrophilic nanofibers each are a value as measured using an electron microscope or the like.

(Forming Materials for Hydrophilic Nanofibers)

The hydrophilic nanofibers that are used in one embodiment of the present invention may be constituted of a forming material including a compound with hydrophilicity. Examples of the compound with hydrophilicity include compounds having a functional group having a hydrogen-bonding hydroxyl group, such as a hydroxy group or an amino group, and metal oxides.

However, from the viewpoint of providing a grease composition that is low in an environmental load and excellent in safety for human bodies and the viewpoint of making an affinity with the base oil satisfactory, the hydrophilic nanofibers that are used in one embodiment of the present invention preferably include a polysaccharide, more preferably include one or more polysaccharides selected from cellulose, carboxymethyl cellulose, chitin, and chitosan, and still more preferably cellulose.

As a raw material for cellulose nanofibers, lignocellulose is also usable. It is known that lignocellulose is a composite hydrocarbon polymer that constitutes a cell wall of plants, and is mainly composed of polysaccharides of cellulose and hemicellulose and an aromatic polymer of lignin. The cellulose that constitutes cellulose nanofibers may be one or more selected from lignocellulose and acetylated lignocellulose. Cellulose nanofibers may contain one or more selected from hemicellulose and lignin. Further, the cellulose to constitute cellulose nanofibers may chemically bond to one or more selected from hemicellulose and lignin.

Also a fiber-reinforced resin (also referred to as resin-reinforcing fiber) containing cellulose nanofibers and a thermoplastic resin is known. Cellulose nanofibers and a thermoplastic resin may be mixed or kneaded, and may be dispersed together. The thermoplastic resin includes polyethylene, polypropylene, polyvinyl chloride, polystyrene, polyvinylidene chloride, fluororesin, (meth)acrylic resin, polyamide resin, polyester, polylactic acid resin, polylactic acid/polyester copolymer resin, acrylonitrile-butadiene-styrene copolymer, polycarbonate, polyphenylene oxide, (thermoplastic) polyurethane, polyacetal, vinyl ether resin, polysulfone resin, and cellulose resin (e.g., triacetylated cellulose, deacetylated cellulose). Here, (meth)acryl means acryl and/or methacryl.

One alone or two or more kinds of these thermoplastic resins may be used either singly or as combined.

The hydrophilic nanofibers that are used in one embodiment of the present invention may be surface-modified.

More specifically, herein usable are hydrophilic nanofibers surface-modified through one or more modification treatments selected from esterification such as acetylation, and also phosphorylation, urethanization, carbamidation, etherification, carboxymethylation, TEMPO (2,2,6,6-tetramethylpipericlin-1-oxyl radical) oxidation, and periodate oxidation.

In the hydrophilic nanofibers that are used in one embodiment of the present invention, the content of the polysaccharide is preferably 60 to 100% by mass, more preferably 70 to 100% by mass, still more preferably 80 to 100% by mass, and yet still more preferably 90 to 100% by mass based on the total amount (100% $b_y$ mass) of the hydrophilic nanofibers.

The degree of polymerization of the polysaccharide is preferably 50 to 3,000, more preferably 100 to 1,500, still more preferably 150 to 1,000, and yet still more preferably 200 to 800.

In the present invention, the degree of polymerization of the polysaccharide polymer means a value as measured by through viscometry.

(Content of Hydrophilic Nanofibers)

In the grease composition of one embodiment of the present invention, the content of the hydrophilic nanofibers is preferably 0.1 to 20% by mass, more preferably 0.5 to 17% by mass, still more preferably 0.7 to 15% by mass, and yet still more preferably 1.0 to 10% by mass based on the total amount (100% by mass) of the grease composition.

When the content of the hydrophilic nanofibers is 0.1% by mass or more, a grease composition having an appropriate worked penetration may be readily provided.

On the other hand, when the content of the hydrophilic nanofibers is 20% by mass or less, a grease composition that is excellent in wear resistance may be readily provided.

<Organic Bentonite>

The organic bentonite is one prepared by modifying the crystal surface of a clay mineral, montmorillonite through treatment with a quaternary ammonium compound.

Not specifically limited, the quaternary ammonium compound may be any one capable of modifying the crystal surface of a clay mineral, montmorillonite, and examples thereof include dimethylalkylammonium such as dimethylclioctadecylammonium; trimethylalkylammonium such as trimethyloctadecylammonium; and trialkylbenzylammonium. Among these, dimethylalkylammonium such as dimethyldioctadecylammonium is preferred.

One alone or two or more kinds of quaternary ammonium compounds may be used either singly or as combined.

Also one alone or two or more kinds of organic bentonite may be used either singly or as combined.

In general, an organic bentonite is cleaved when subjected to shear in the presence of a polar compound in a base oil and functions as a thickener. However, bentonite such as an organic bentonite is difficult to uniformly disperse in a base oil. Consequently, in general, a large amount of bentonite is blended in a grease composition using bentonite as a thickener (bentonite grease) to control the worked penetration of the composition. Specifically, in general, bentonite is blended in an amount of 20% by mass or more relative to the total amount (100% by mass) of the grease composition.

As opposed to this, in the present invention, hydrophilic nanofibers are used along with an organic bentonite, and therefore the organic bentonite can be uniformly dispersed in the base oil. Precisely, the hydrophilic surface (the surface having a hydrophilic group) of an organic bentonite adsorbs the hydrophilic group of hydrophilic nanofibers, or the hydrophilic surface thereof comes close to the hydrophilic group of hydrophilic nanofibers, and therefore the organic bentonite disperses close to the uniformly dispersing hydrophilic nanofibers. As a result, the organic bentonite is uniformly dispersed and arranged to likely surround the hydrophilic group of the hydrophilic nanofibers. Consequently, it is presumed that the hydrophilic nanofibers could be simulatively hydrophobized and excellent water resistance could be thereby given to the grease composition and oil separation from the grease composition can be prevented.

In addition, in a base oil, hydrophilic nanofibers can readily form a high-order structure. Also it is easy to uniformly disperse hydrophilic nanofibers in a base oil. As a result, even though the content of the hydrophilic nanofibers is small and the content of the organic bentonite is small, a grease composition having a suitable worked penetration can be provided.

A method for producing an organic bentonite is disclosed in detail, for example, in JP 62-83108 A and JP 53-72792 A.

(Content of Organic Bentonite)

In the grease composition of one embodiment of the present invention, the content of the organic bentonite is, based on the total amount (100% by mass) of the grease composition, preferably 0.1 to 15% by mass, more preferably 0.5 to 12% by mass, even more preferably 0.7 to 10% by mass, further more preferably 1.0 to 8% by mass.

When the content of the organic bentonite is 0.1% by mass or more, a grease composition having more excellent water resistance and capable of more efficiently suppressing oil separation can be readily prepared.

On the other hand, when the content of the organic bentonite is 20% by mass or less, a grease composition excellent in long-term wear resistance can be readily prepared.

<Various Additives>

The grease composition of one embodiment of the present invention may further contain various additives that are blended in general greases composition within a range where the effects of the present invention are not impaired.

Examples of the various additives include a rust inhibitor, an antioxidant, a lubricity improver, a thickening agent, a dispersing auxiliary agent, a detergent dispersant, a corrosion inhibitor, an anti-foaming agent, an extreme pressure agent, and a metal deactivator.

These various additives may be used either alone or in combination of two or more thereof.

The grease composition of one embodiment of the present invention may contain the dispersant and water used in grease formation within a range where the grease state may be maintained.

In the grease composition of one embodiment of the present invention, the total content of the dispersant and water is preferably 0 to 60% by mass, more preferably 0 to 30% by mass, still more preferably 0 to 10% by mass, and yet still more preferably 0 to 5% by mass based on the total amount (100% by mass) of the grease.

(Rust Inhibitor)

Examples of the rust inhibitor include a carboxylic acid-based rust inhibitor, an amine-based rust inhibitor, and a carboxylate-based rust inhibitor.

In the case where the grease composition of one embodiment of the present invention contains a rust inhibitor, the content of the rust inhibitor is preferably 0.1 to 10.0% by mass, more preferably 0.3 to 8.0% by mass, and still more preferably 1.0 to 5.0% by mass based on the total amount (100% by mass) of the grease composition.

(Antioxidant)

Examples of the antioxidant include an amine-based antioxidant, a phenol-based antioxidant, a sulfur-based antioxidant, and zinc dithiophosphate.

In the case where the grease composition of one embodiment of the present invention contains an antioxidant, the content of the antioxidant is preferably 0.05 to 10% by mass, more preferably 0.1 to 7% by mass, and still more preferably 0.2 to 5% by mass based on the total amount (100% by mass) of the grease composition.

(Lubricity Improver)

Examples of the lubricity improver include a sulfur compound (for example, a sulfurized fat and oil, a sulfurized olefin, a polysulfide, a sulfurized mineral oil, a thiophosphate such as triphenyl phosphorothioate, a thiocarbamate, a thioterpene, a dialkyl thiodipropionate), and a phosphate and a phosphite (for example, tricresyl phosphate, triphenyl phosphite).

In the case where the grease composition of one embodiment of the present invention contains a lubricity improver, the content of the lubricity improver is preferably 0.01 to 20% by mass, more preferably 0.1 to 10% by mass, and still more preferably 0.2 to 5% by mass based on the total amount (100% by mass) of the grease composition.

(Thickening Agent)

The thickening agent is one for increasing the viscosity of the base oil as needed and is blended for the purpose of adjusting the base oil including the thickening agent to have an appropriate kinematic viscosity.

Examples of the thickening agent include a polymethacrylate (PMA), an olefin copolymer (OCP), a polyalkylstyrene (PAS), and a styrene-diene copolymer (SCP).

In the case where the grease composition of one embodiment of the present invention contains a thickening agent, the content of the thickening agent is preferably 0.01 to 20% by mass, more preferably 0.1 to 10% by mass, and still more preferably 0.2 to 5% by mass based on the total amount (100% by mass) of the grease composition.

(Dispersing Auxiliary Agent)

Examples of the dispersing auxiliary agent include a succinic acid half ester, urea, and various surfactants.

In the case where the grease composition of one embodiment of the present invention contains a dispersing auxiliary agent, the content of the dispersing auxiliary agent is preferably 0.01 to 20% by mass, more preferably 0.1 to 10% by mass, and still more preferably 0.2 to 5% by mass based on the total amount (100% by mass) of the grease composition.

(Detergent Dispersant, Corrosion Inhibitor, Anti-foaming Agent, Extreme Pressure Agent, Metal Deactivator)

Examples of the detergent dispersant include a succinimide, and a boron-based succinimide.

Examples of the corrosion inhibitor include a benzotriazole-based compound, and a thiazole-based compound.

Examples of the anti-foaming agent include a silicone-based compound, and a fluorinated silicone-based compound.

Examples of the extreme pressure agent include a phosphorus-based compound, zinc dithiophosphate, and an organomolybdenum.

Examples of the metal deactivator include a benzotriazole.

In the case where the grease composition of one embodiment of the present invention contains these additives, the content of each of these additives is preferably 0.01 to 20% by mass, more preferably 0.1 to 10% by mass, and still more preferably 0.2 to 5% by mass based on the total amount (100% by mass) of the grease composition.

[Characteristics of Grease Composition of the Present Invention]

In the grease composition of the present invention, the hydrophilic group of the hydrophilic nanofibers is protected with the organic bentonite, and therefore the hydrophilic nanofibers are simulatively hydrophobized. Consequently, the grease composition of the present invention has excellent water resistance and hardly experiences oil separation.

In addition, in the grease composition of the present invention, the hydrophilic nanofibers can readily form a high-order structure, and therefore the hydrophilic nanofibers are uniformly dispersed in the base oil. In addition, the organic bentonite is also uniformly dispersed in the base oil. Consequently, the grease composition of the present invention can have a suitable worked penetration even though the content of the hydrophilic nanofibers and the organic bentonite therein is small.

(Water Resistance)

The water washout resistance at 38° C. of the grease composition of one embodiment of the present invention is preferably 5.5% by mass or less, more preferably 5.0% by mass or less, even more preferably 3.0% by mas or less, further more preferably 2.0% by mass or less, further more preferably 1.0% by mass or less, further more preferably 0% by mass.

In this description, the water washout resistance at 38° C. of the grease composition is a value measured according to the water washout resistance test method of JIS K2220: 2013.

(Oil Separation Degree)

The oil separation degree of the grease composition of one embodiment of the present invention is, from the viewpoint of obtaining a grease composition having a longer lifetime, preferably 6% by mass or less, more preferably 5.5% by mass or less, even more preferably 5.0% by mass or less, still more preferably 4.5% by mass or less. In general, it is 0.5% by mass or more.

In this description, the oil separation degree of the grease composition is a value determined according to an oil separation degree test method of JIS K2220:2013, in which the proportion by mass of the oil separated from the grease composition is measured.

(Worked Penetration)

The worked penetration at 25° C. of the grease composition of one embodiment of the present invention is, from the viewpoint of controlling the hardness of the grease composition to fall within a suitable range and bettering the low-temperature torque property and the wear resistance thereof, preferably 130 to 475, more preferably 160 to 445, even more preferably 175 to 430, still more preferably 200 to 350.

In this description, the worked penetration of the grease composition is a value measured according to JIS K2220 7:2013.

[Method for Producing Grease Composition of the Present Invention]

A method for producing the grease composition of the present invention includes the following steps (1) to (3).

Step (1); a step of mixing a water dispersion prepared by blending hydrophilic nanofibers having a thickness (d') of 1 to 500 nm, preferably 3 to 300 nm, more preferably 5 to 200 nm, even more preferably 10 to 100 nm, further more preferably 15 to 70 nm, further more preferably 20 to 50 nm in water, a base oil and a dispersant to prepare a liquid mixture;

Step (2): a step of removing water from the liquid mixture to prepare a grease;

Step (3): a step of blending an organic bentonite in the grease.

The step (2) may also be a step of removing water and the dispersant from the liquid mixture.

In the grease composition produced through the steps, the hydrophilic nanofibers are prevented from aggregating together in the base oil, and while kept to have a fibrous form and while having a thickness (d) of 1 to 500 nm, preferably 3 to 300 nm, more preferably 5 to 200 nm, even more preferably 10 to 100 nm, further more preferably 15 to 70 nm, further more preferably 20 to 50 nm, the hydrophilic nanofibers can be dispersed in the base oil. As a result, the hydrophilic nanofibers can form a high-order structure in the base oil, and the hydrophilic nanofibers can be uniformly dispersed in the base oil, and in addition, the organic bentonite is also uniformly dispersed in the base oil to surround the hydrophilic group of the hydrophilic nanofibers, and accordingly, a grease composition given excellent water resistance and prevented from oil separation can be prepared.

Hereinunder the steps (1) to (3) are described.

<Step (1)>

The step (1) is a step of mixing a water dispersion prepared by blending hydrophilic nanofibers having a thickness (d') of 1 to 500 nm, preferably 3 to 300 nm, more preferably 5 to 200 nm, even more preferably 10 to 100 nm, further more preferably 15 to 70 nm, further more preferably 20 to 50 nm in water, a base oil and a dispersant to prepare a liquid mixture.

Details of the hydrophilic nanofibers and the base oil that are used in the step (1) are as described above.

The "thickness (d')" as referred to herein expresses the thickness of the hydrophilic nanofiber as a raw material prior to being blended in the base oil or water as described above, and a preferred range of the "thickness (d')" is the same as described above.

A solid concentration of the water dispersion having the hydrophilic nanofibers blended therein is typically 0.1 to 70% by mass, preferably 0.1 to 65% by mass, more preferably 0.1 to 60% by mass, still more preferably 0.5 to 55% by mass, and yet still more preferably 1.0 to 50% by mass based on the total amount (100% by mass) of the water dispersion.

The water dispersion may be prepared by blending the hydrophilic nanofibers and optionally a surfactant in water, followed by thoroughly stirring manually or by using a stirrer.

As the hydrophilic nanofibers, a powdered hydrophilic nanofiber may be used, and this may be added to water to form a water dispersion.

The dispersant may be a solvent that is good in compatibility with both water and oil, and it is preferably one or more selected from aprotic polar solvents, such as N,N-dimethylformamide (DMF), N,N-dimethylacetamide (DMAc), and N-methylpyrrolidone (NMP); alcohols, such as propanol, ethylene glycol, propylene glycol, and hexylene glycol; and surfactants, such as a polyglycerin fatty acid ester, a sucrose fatty acid ester, a citric acid monoglyceride, a diacetyltartaric acid monoglyceride, a polyoxyethylene sorbitan acid ester, and sorbitan acid ester.

A blending amount of the dispersant in the liquid mixture that is prepared in the step (1) is preferably 0.1 to 50% by mass, more preferably 0.5 to 40% by mass, still more preferably 1.0 to 30% by mass, further more preferably 1.0 to 20% by mass, further more preferably 1.0 to 10% by mass based on the total amount (100% by mass) of the liquid mixture.

A blending amount of water in the liquid mixture that is prepared in the step (1) is preferably 1 to 60% by mass, more preferably 3 to 50% by mass, still more preferably 5 to 40% by mass based on the total amount (100% by mass) of the liquid mixture.

A blending ratio of water to the dispersant [(water)/(dispersant)] in the liquid mixture that is prepared in the step (1) is preferably 0.01 to 600, more preferably 0.05 to 400, still more preferably 0.1 to 300, and yet still more preferably 0.2 to 200 in terms of a mass ratio.

In the liquid mixture, the aforementioned various additives that are blended in general grease compositions may be added together with the water dispersion having the hydrophilic nanofibers blended therein, the base oil and the dispersant. The liquid mixture may be prepared by mixing these components, followed by thoroughly stirring them manually or by using a stirrer.

<Step (2)>

The step (2) is a step of removing at least water from the liquid mixture prepared in the step (1).

In this step, the dispersant may be removed together with water from the liquid mixture.

As a method of removing water and the dispersant, a method of heating the liquid mixture to evaporate and remove water and the dispersant is preferred.

As a condition under which water is evaporated and removed, it is preferred that the liquid mixture is heated at a temperature ranging from 0 to 100° C. in an environment at a pressure of 0.001 to 0.1 MPa.

As a condition under which the dispersant is evaporated and removed, it is preferred that the liquid mixture is heated at a temperature ranging from [boiling point (° C.) of the dispersant] minus 120° C. to [boiling point (° C.) of the dispersant] minus 0° C. in an environment at a pressure of 0.001 to 0.1 MPa.

The evaporation and removal of water and the dispersant may be performed by means of atmospheric distillation.

The step (2) produces a grease.

<Step (3)>

The step (3) is a step of blending an organic bentonite in the grease prepared in the step (2).

Specifically, for example, the grease prepared in the step (2) is mixed with an organic bentonite, and, for example, homogenized using a roll mill or the like to prepare a grease composition of the present invention.

[Mechanical Component Filled with Grease Composition of the Present Invention]

The grease composition of the present invention has excellent water resistance and hardly experiences oil separation. In addition, it has a suitable worked penetration.

Moreover, the grease composition of the present invention has a suitable worked penetration even though the content of the hydrophilic nanofibers acting as a thickener and the content of the organic bentonite are small, and therefore can have improved wear resistance. Further, the wear resistance can be maintained for a long period of time.

Further, the hydrophilic nanofibers and the organic bentonite are low in an environmental load and excellent in safety for human bodies. Accordingly, the grease composition of the present invention has a low environmental load and a high safety for human bodies.

Consequently, even when the grease therein is scattered or leaked, the mechanical component using the grease composition of the present invention is less in problems regarding environmental preservation or safety for human bodies, and the lubricating characteristics thereof can be maintained over a long period of time.

Examples of the mechanical component filled with the grease composition of the present invention include bearings and gears. More specifically, examples thereof include various bearings, such as a sliding bearing and a roll bearing, a gear, an internal combustion engine, a brake, a component for torque transmission apparatus, a fluid clutch, a component for compression apparatus, a chain, a component for hydraulic apparatus, a component for vacuum pump apparatus, a clock component, a component for hard disk, a component for refrigerating machine, a component for cutting machine, a component for rolling machine, a component for draw bench, a component for rolling machine, a component for forging machine, a component for heat treatment machine, a component for heat exchanger, a component for washing machine, a component for shock absorber, and a component for sealing apparatus.

The grease of one embodiment of the present invention is also suitable for a lubricating application of sliding portions of food machinery, such as bearings, and gears.

From the foregoing sections, the present invention also provides the following mechanical component and method for use of grease composition.

(1) A mechanical component filled with the grease composition of the present invention.

(2) A method for use of a grease composition, including using the grease composition of the present invention for lubrication of mechanical components.

The mechanical component as described in the above item (1) is preferably a mechanical component to be installed in a food machinery for processing of food raw materials of food raw materials, and production of foods.

The "grease composition" that is used in the above items (1) and (2) is the grease composition of the present invention, and details thereof are as described above.

EXAMPLES

The present invention is described in more detail by reference to Examples given below, but it should be construed that the present invention is by no means limited to these Examples.

[Property Values of Raw Materials]

Property values of raw materials were determined according to the following methods.

(1) Thickness and Aspect Ratio of Hydrophilic Nanofibers

Ten arbitrarily selected hydrophilic nanofibers were each measured with respect to the thickness and the length thereof by using a transmission electron microscope (TEM), and a value as calculated from "length/thickness" was defined as an "aspect ratio" of the hydrophilic nanofibers measured.

(2) Kinematic Viscosity at 40° C., Viscosity Index

The measurement and calculation were performed in conformity with JIS K2283:2000.

Examples 1 to 6, Comparative Examples 1 to 3

In Examples 1 to 6, and Comparative Examples 1 to 3, a base oil, a hydrophilic nanofiber dispersion, an organic bentonite and a dispersant shown below were used.

<Base Oil>

PAO: Kinematic viscosity at 40° C.=64 $mm^2/s$, viscosity index=135, poly-α-olefin <Hydrophilic Nanofiber Dispersion>

Trade name "BiNFi-s", manufactured by Sugino Machine Limited (water dispersion containing cellulose nanofibers (CNF) having a degree of polymerization of 600 (thickness (d')=20 to 50 nm (average value: 35 nm), aspect ratio=100 or more (average value: 100 or more))

<Organic Bentonite>

Organic bentonite 1: Benton 27 (manufactured by Elementis Specialties, Inc.)

Organic bentonite 2: Baragel 3000 (manufactured by Elementis Specialties, Inc.)

Organic bentonite 3: S-BEN (manufactured by Hojun Co., Ltd.)

Organic bentonite 4: Benton 34 (manufactured by Elementis Specialties, Inc.)

<Unprocessed Bentonite>

Unprocessed bentonite 1: Superclay (manufactured by Hojun Co., Ltd.)

<Dispersant>

Sorbitan acid ester

Example 1

166 g (in this, CNF amount: 16.6 g) of the hydrophilic nanofiber dispersion, 174 g of the base oil and 5.0 g of the dispersant were mixed, and well stirred at 25° C. to prepare a liquid mixture.

Then, the liquid mixture was heated up to 90° C. in an environment at 0.02 MPa to evaporate and remove water from the liquid mixture.

Next, this was cooled to room temperature (25° C.), and 4.0 g of the organic bentonite was added to the liquid mixture and well stirred, and then homogenized using a three-roll mill to prepare a grease composition (a) having the formulation shown in Table 1.

Example 2

A grease composition (b) having the formulation shown in Table 1 was prepared according to the same method as in Example 1, except that 130 g (in this, CNF amount: 13.0 g) of the hydrophilic nanofiber dispersion was used, 170 g of the base oil was used, 4.0 g of the dispersant was used, and 13.0 g of the organic bentonite was used.

Example 3

A grease composition (c) having the formulation shown in Table 1 was prepared according to the same method as in Example 1, except that 160 g (in this, CNF amount: 16.0 g) of the hydrophilic nanofiber dispersion was used, 171 g of the base oil was used, 4.8 g of the dispersant was used, and the organic bentonite 1 was changed to the organic bentonite 2 and 8.0 g thereof was used.

Example 4

A grease composition (d) having the formulation shown in Table 1 was prepared according to the same method as in Example 3, except that 140 g (in this, CNF amount: 14.0 g) of the hydrophilic nanofiber dispersion was used, 168 g of the base oil was used, 4.2 g of the dispersant was used, and 14.0 g of the organic bentonite 2 was used.

Example 5

A grease composition (e) having the formulation shown in Table 1 was prepared according to the same method as in Example 4, except that the organic bentonite 2 was changed to the organic bentonite 3.

Example 6

A grease composition (f) having the formulation shown in Table 1 was prepared according to the same method as in Example 4, except that the organic bentonite 2 was changed to the organic bentonite 4.

Comparative Example 1

200 g (in this, CNF amount: 20 g) of the hydrophilic nanofiber dispersion, 174 g of the base oil and 6.0 g of the dispersant were mixed and fully stirred at 25° C. to prepare a liquid mixture.

Then, the liquid mixture was heated up to 70° C. in an environment at 0.01 MPa to evaporate and remove water from the liquid mixture.

Next, this was cooled to room temperature (25° C.), and then homogenized using a three-roll mill to prepare a grease composition (g) having the formulation shown in Table 2.

Comparative Example 2

A grease composition (h) having the formulation shown in Table 2 was prepared according to the same method as in Example 4, except that the organic bentonite 2 was changed to the unprocessed bentonite 1.

Comparative Example 3

A grease composition (i) having the formulation shown in Table 2 was prepared according to the same method as in Comparative Example 2, except that 20 g of the unprocessed bentonite 1 was used.

[Evaluation]

The worked penetration of the prepared grease compositions (a) to (i) was measured.

In addition, the prepared grease compositions (a) to (i) were tested according to a water washout resistance test and an oil separation test as mentioned below.

The results are shown in Table 1 and Table 2.

In Table 1 and Table 2, the content (unit: % by mass) of each component of the prepared grease compositions (a) to (i) is also shown.

<Worked Penetration>

Measured at 25° C. according to JIS K2220 7:2013.

<Water Washout Resistance Test>

Using water at 38° C., and according to the method of a water washout resistance test of JIS K2220:2013, the mass of the grease composition that had been washed away in water relative to 100% by mass of the amount of the grease composition before the test was measured.

A grease composition having a large value of the mass measured can be said to be a grease having a low water resistance. On the other hand, a grease composition having a small value of the mass can be said to be a grease composition excellent in water resistance.

The grease composition (i) of Comparative Example 3 was not subjected to the water washout resistance test.

<Degree of Oil Separation>

According to the oil separation degree test method of JIS K2220:2013, the ratio by mass of the oil separated from the grease composition was measured.

TABLE 1

| | | Example 1 Grease Composition (a) | Example 2 Grease Composition (b) | Example 3 Grease Composition (c) | Example 4 Grease Composition (d) | Example 5 Grease Composition (e) | Example 6 Grease Composition (f) |
|---|---|---|---|---|---|---|---|
| Base Oil | | 87.2 | 85 | 85.6 | 83.9 | 83.9 | 83.9 |
| Organic Bentonite or Unprocessed Bentonite | Organic Bentonite 1 | 2 | 6.5 | — | — | — | — |
| | Organic Bentonite 2 | — | — | 4 | 7 | — | — |
| | Organic Bentonite 3 | — | — | — | — | 7 | — |
| | Organic Bentonite 4 | — | — | — | — | — | 7 |
| | Unprocessed Bentonite 1 | — | — | — | — | — | — |
| CNF | | 8.3 | 6.5 | 8 | 7 | 7 | 7 |
| CNF/Bentonite (ratio by mass) | | 4.2 | 1.0 | 2.0 | 1.0 | 1.0 | 1.0 |
| Sorbitan Acid Ester | | 2.5 | 2 | 2.4 | 2.1 | 2.1 | 2.1 |
| Total | | 100 | 100 | 100 | 100 | 100 | 100 |

TABLE 1-continued

| | | Example 1 Grease Composition (a) | Example 2 Grease Composition (b) | Example 3 Grease Composition (c) | Example 4 Grease Composition (d) | Example 5 Grease Composition (e) | Example 6 Grease Composition (f) |
|---|---|---|---|---|---|---|---|
| Evaluation Results | Worked Penetration | 220 | 299 | 250 | 256 | 254 | 257 |
| | Water Washout Resistance (38° C.) | 1.6 | 0.0 | 1.0 | 1.1 | 5.1 | 0.0 |
| | Degree of Oil Separation (% by mass) | 2.2 | 2.9 | 4.2 | 3.2 | 3.7 | 1.5 |

TABLE 2

| | | Comparative Example 1 Grease Composition (g) | Comparative Example 2 Grease Composition (h) | Comparative Example 3 Grease Composition (i) |
|---|---|---|---|---|
| | Base Oil | 87 | 83.9 | 88 |
| Organic Bentonite or Unprocessed Bentonite | Organic Bentonite 1 | — | — | 10 |
| | Organic Bentonite 2 | — | — | — |
| | Organic Bentonite 3 | — | — | — |
| | Organic Bentonite 4 | — | — | — |
| | Unprocessed Bentonite 1 | — | 7 | — |
| | CNF | 10 | 7 | — |
| | CNF/Bentonite (ratio by mass) | — | 1.0 | — |
| | Sorbitan Acid Ester | 3 | 2.1 | 2 |
| | Total | 100 | 101 | 100 |
| Evaluation Results | Worked Penetration | 273 | 277 | 430 |
| | Water Washout Resistance (38° C.) | 98.5 | 52.0 | — |
| | Degree of Oil Separation (% by mass) | 6.7 | 8.1 | 13.5 |

Table 1 and Table 2 confirm the following.

It is known that the grease compositions (a) to (f) obtained in Examples 1 to 6 have a suitable worked penetration and have excellent water resistance and oil separation degree.

As opposed to these, it is known that the grease composition (g) obtained in Comparative Example 1, in which an organic bentonite was not blended and CNF was blended, has a suitable worked penetration but has poor water resistance.

It is known that, when an unprocessed bentonite is blended in place of an organic bentonite as in the grease composition (h) in Comparative Example 2, the water resistance of the grease composition is low, that is, the unprocessed bentonite could not impart water resistance to a grease composition.

Further, It is known that a grease composition blended with an organic bentonite but not with CNF, like the grease composition (i) of Comparative Example 3, could not maintain a grease form and readily experienced oil separation.

In addition, It is known that the grease compositions (a) to (f) of Examples 1 to 6 tend to hardly experience oil separation as compared with the grease compositions (g) to (i) of Comparative Examples 1 to 3.

In Example 1, whether or not the thickness of the hydrophilic nanofibers would change before and after preparation of the grease composition (a) was checked, and as a result, it was confirmed that the thickness changes little before and after the preparation. From this, it is considered that there is little difference between the "thickness (d) of the hydrophilic nanofibers" dispersed in the base oil and the "thickness (d') of the hydrophilic nanofibers" as a raw material before blended in the base oil, and the two are substantially the same.

The invention claimed is:

1. A grease composition comprising a base oil, from 0.1 to 20% by mass of hydrophilic nanofibers having a thickness (d) of 1 to 500 nm, based on the total amount of the grease composition, and from 1.0 to 10% by mass of an organic bentonite, based on the total amount of the grease composition, wherein the content ratio of the hydrophilic nanofibers to the organic bentonite is 1.0 to 5.0 as a ratio by mass, wherein the hydrophilic nanofibers contain one or more polysaccharides selected from cellulose, carboxymethyl cellulose, chitin and chitosan.

2. The composition of claim 1, wherein the aspect ratio of the hydrophilic nanofibers is 5 or more.

3. A mechanical component filled with the composition of claim 1.

4. A method of producing a grease composition according to claim 1, comprising:

mixing a water dispersion prepared by blending the hydrophilic nanofibers having a thickness (d') of 1 to 500 nm in water, the base oil and a dispersant to prepare a liquid mixture;

removing water from the liquid mixture to prepare a grease; and blending the organic bentonite in the grease.

5. The method of claim 4, wherein the dispersant is one or more selected from aprotic polar solvents, alcohols and surfactants.

* * * * *